United States Patent [19]

Bergenwall

[11] Patent Number: 4,549,720

[45] Date of Patent: Oct. 29, 1985

[54] DEVICE FOR RAISING AND LOWERING OBJECTS

[76] Inventor: Henning Bergenwall, Trollstigen 2, Sandviken, Sweden, 811 36

[21] Appl. No.: 579,906

[22] PCT Filed: May 13, 1983

[86] PCT No.: PCT/SE83/00192

§ 371 Date: Jan. 19, 1984

§ 102(e) Date: Jan. 19, 1984

[87] PCT Pub. No.: WO83/04168

PCT Pub. Date: Dec. 8, 1983

[30] Foreign Application Priority Data

May 21, 1982 [SE] Sweden ..... 8203189

[51] Int. Cl.[4] ..... B66F 3/00

[52] U.S. Cl. ..... 254/124; 187/8.71; 187/18

[58] Field of Search ..... 254/9 C, 122, 124; 182/141, 63; 187/8.71, 8.72, 18

[56] References Cited

U.S. PATENT DOCUMENTS

| | | | |
|---|---|---|---|
| 2,706,102 | 4/1955 | Cresci | 254/124 |
| 3,032,319 | 5/1962 | Dale | 187/18 |
| 3,901,356 | 8/1975 | Butler | 187/8.71 |
| 4,114,854 | 9/1978 | Clark | 187/18 |

*Primary Examiner*—Frederick R. Schmidt
*Assistant Examiner*—Judy J. Hartman
*Attorney, Agent, or Firm*—Zarley, McKee, Thomte, Voorhees & Sease

[57] ABSTRACT

A device for raising and lowering objects comprises a stand (1), an arm (5) pivotably supported on the stand for carrying a bed frame or the like, a power mechanism (8) for pivoting the arm (5) and a wedge (12) which is insertable between portions of the stand and arm in order to actuate these portions away from each other and thereby pivot the arm upwardly from the stand. The wedge (12) is movable perpendicularly to the pivot axis (6) of the arm (5) and is connected to a dog (18) adapted to abut a component (28) connected to the arm (5) after a certain initial introduction of the wedge between said portions (9, 10).

4 Claims, 4 Drawing Figures

DEVICE FOR RAISING AND LOWERING OBJECTS

FIELD OF INVENTION AND PRIOR ART

This invention relates to a device of the kind defined in the preamble of appendant claim 1.

Such a device is known by FR-A No. 1 560 817. In this device, the element producing the wedge action is formed by a slide, which is guidedly movable in a horizontal path. The element has the character of a long beam, at the outer end of which the wedge portion is arranged. When the wedge portion, which apart from the contact with the support arm is freely located, urges the support arm to pivot upwardly, the element is exposed to a downwardly directed force giving rise to a torque, which may cause jamming with regard to the guiding of the element relative to the stand since this guide has to maintain the element in the horizontal path of movement and prevent pivoting downwardly of the wedge portion. Furthermore, a hinge between the wedge element and the power mechanism is, in the device according to the patent, located above the area of contact between the dog and the support arm or the part connected thereto, which on displacement of the element in order to pivot the support arm upwardly, gives rise to a torque on the element tending to pivot its wedge portion downwardly, which causes additional risk of jamming and loss of energy.

BRIEF DISCLOSURE OF THE INVENTION

The object of the invention is to devise a way for reducing the deficiencies discussed hereinabove.

This object is primarily obtained by that defined in the characteristic of claim 1. In this way, an embodiment is obtained, in which the forces acting on the wedge portion of the element in a direction downwardly during lifting of the support arm are balanced by means of the portion of the stand located therebelow so that the guide problems occurring in the French patent discussed previously are eliminated. This is in particular due to the fact that the mobility of the wedge portion in a vertical sense eliminates such breaking stresses which may occur in the device according to the patent by those guides which serve to maintain the element in its horizontal path of movement. Moreover, the design according to the invention makes it possible to obtain, by location of the hinge between the wedge element and the power mechanism below the area of contact of the dog, such actuation of the wedge portion that it will move upwardly during pivoting upwardly of the arm. Thus, the wedge element will urge the arm upwardly also when the proper wedge action has been terminated, i.e. when the wedge portion has entered out of contact with the stand.

SHORT DESCRIPTION OF THE DRAWINGS

With reference to the appended drawings, a more specific description of an embodiment example of the invention will follow hereinafter.

DETAILED DESCRIPTION OF A PREFERRED EMBODIMENT

Figure 1:
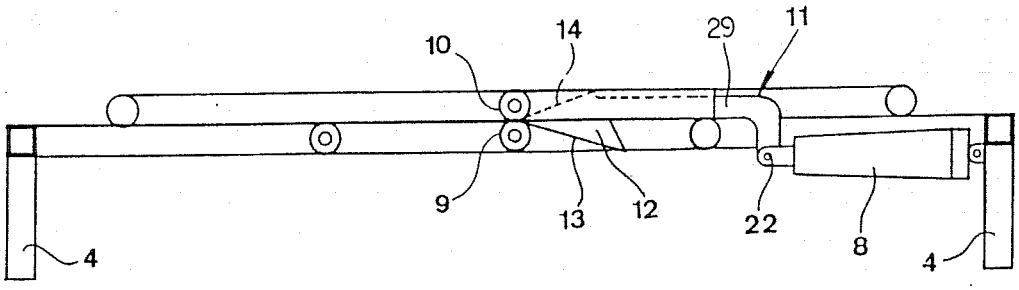
FIG. 1 is a view from the side of the device according to the invention with the support arm lowered.

The device illustrated in the drawings for raising and lowering objects comprises a stand 1 having two longitudinal beams 2 and cross beams 3 arranged at the ends of beams 2. Legs 4 are provided at the outer ends of the cross beams. A support arm 5 is pivotably journalled to the stand about a generally horizontal axis 6. The object to be handled, such as a bed frame, a work table or the like, may be attached in a manner known per se at the upper end of support arm 5 and the cross piece 7 provided thereon. A power mechanism 8 is adapted to pivot arm 5. The mechanism is constituted by a piston cylinder mechanism.

The mechanism 8 is connected to an element 11 which is introducable between portions 9 and 10 of the stand 1 and support arm 5 respectively, said element producing, in cooperation with said portions 9, 10, a wedge action tending to pivot the arm upwardly from the stand.

The element 11 is displaceable generally perpendicularly to the pivot axis 6 of arm 5 and has a wedge shaped forward portion 12. This portion has two surfaces 13 and 14 diverging from the tip of the wedge and adapted to contact portions 9 and 10 respectively.

A second arm 15 is connected to arm 5 via an axis 16 parallel to axis 6. The arm 15 has a portion 17 protruding from the axis 16, the end of said portion being attached to a cross member 28, the opposite ends of which are received in separated guides 19 on the inner sides of the longitudinal beams 2 in such a manner that cross member 28 is displaceable reciprocatingly in the guides and also rotatable about an axis parallel to the pivot axis 6 of arm 5.

The mechanism 8 and element 11 are associated to a dog 18, which is adapted to, after displacement of the wedge portion 12 of the element in a certain degree into a position between portions 9 and 10, abut cross member 28 in order to apply the force developed by the mechanism thereon. The dog 18 is formed by a downwardly directed projection on the element. This projection is connected to wedge portion 12 by means of an intermediate portion 29 extending at an angle to the projection.

Preferably, the arms 5 and 15 are coordinated with the axis 16 between the ends of the arms like a pair of scissors so that also arm 15 with a cross piece 20 located at the end opposite to the cross member 28 may take part in supporting the object in question. On the cross member 28, guide surfaces 21 may be provided, between which portion 29 of element 11 is movable.

The dog 18 is rigidly associated to the connecting portion 29, which in turn is rigidly connected to wedge portion 12. However, the mechanism 8 is hingedly connected (hinge 22) to the outer end of projection 18. The hinge 22 is located below that location where the projection 18 is adapted to contact cross member 28 so that a tendency to pivoting upwardly of wedge portion 12 is obtained on expansion of mechanism 8.

Figure 2:
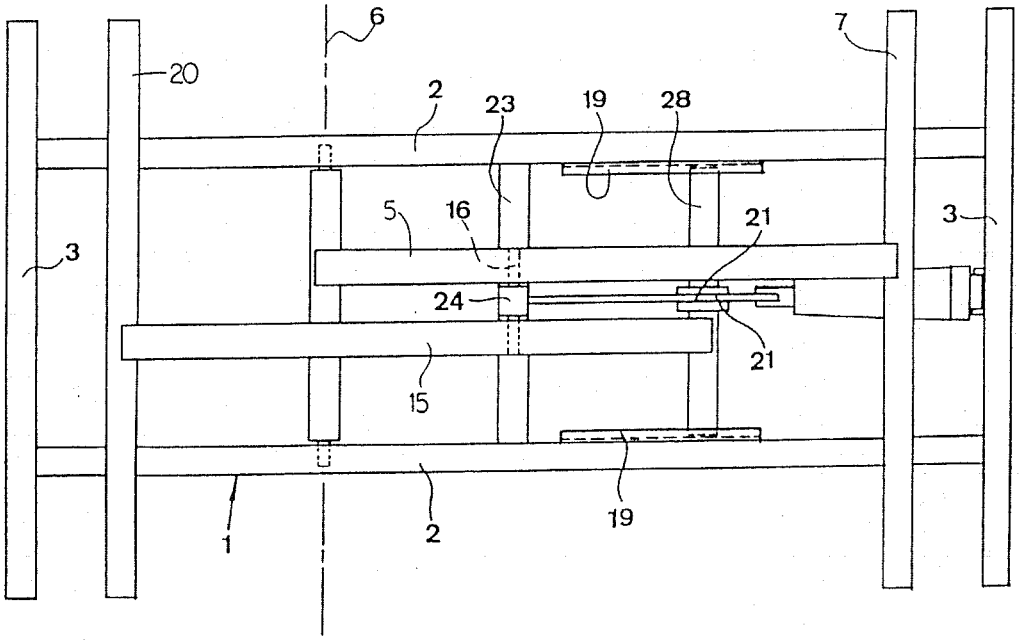
FIG. 2 is a plan view of FIG. 1.

The portions on which the wedge surfaces 13 and 14 actuate are formed by a stationary portion on the stand and a portion located in the area of the hinge 16 between arms 5 and 15. The portion 9 is formed by means of a cross piece 23 extending between the longitudinal beams 2. The cross piece 23 may be provided with a roller to reduce friction relative to wedge surface 13. Another roller 24 may be journalled about axis 16 between arms 5 and 15, said roller being intended for contact with wedge surface 14 and forming said contact portion 10. As appears from FIGS. 1 and 2, arms 5 and 15 are parallel to the upper surface of the stand when the device is folded. Further, it appears from FIG. 1 that the wedge portion 12, when element 11 is maximally retracted by mechanism 8, has its tip retained between the portions or rollers 9 and 10.

Figure 3:
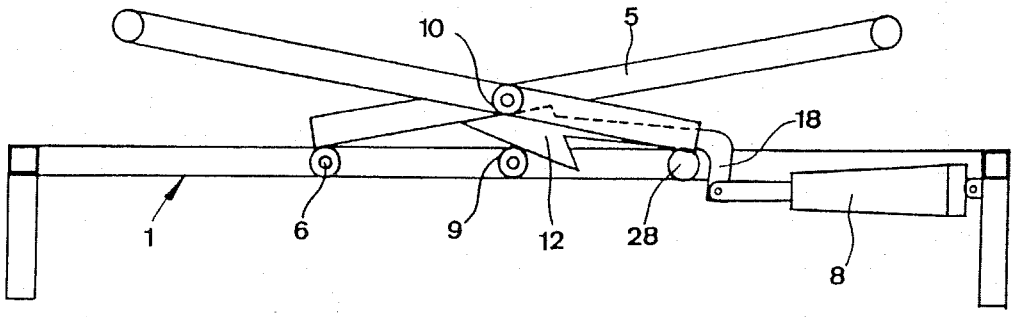
FIG. 3 is a view illustrating the support arm somewhat pivoted upwardly.
Figure 4:
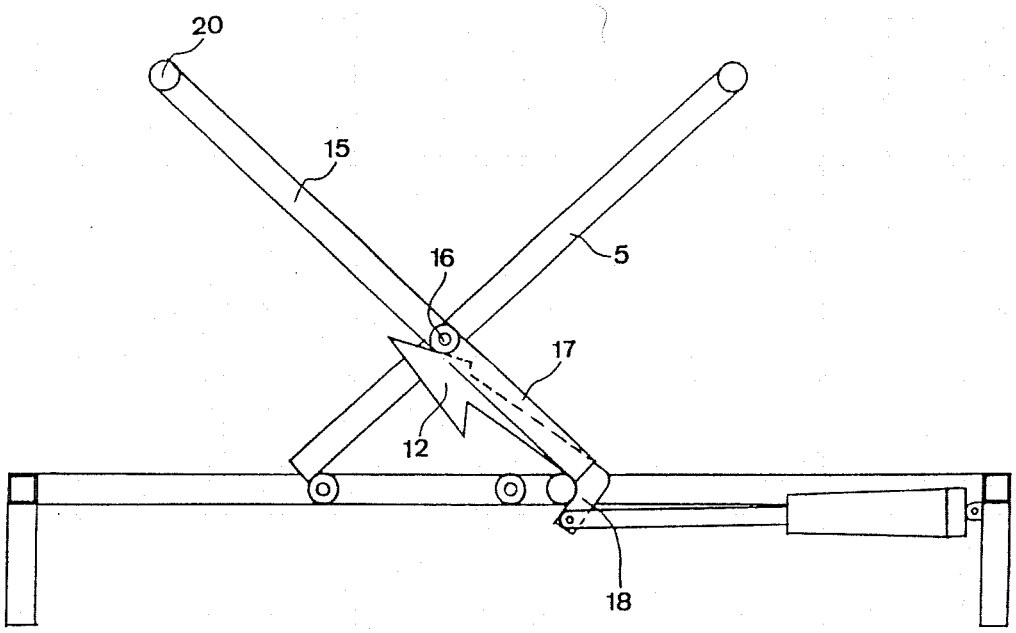
FIG. 4 is a view illustrating the support art fully pivoted upwardly.

The device operates as follows: If it is desired to raise an object carried on the cross pieces 7 and 20 starting from the position according to FIG. 1, the mechanism 8 is supplied with pressure fluid so as to be extended. This causes wedge portion 12 to be introduced between portions 9 and 10 and separate them as illustrated in FIG. 3. Since the pivot axis 6 of arm 5 in this case is stationary relative to the stand, the cross member 28 is displaced in guides 19. By the design of wedge portion 12, a comparatively small amount of power of mechanism 8 is required to obtain initial pivoting upwardly of arms 5 and 15. After some additional expansion of mechanism 8, dog 18 will hit on cross member 28 so that power from mechanism 8 now is applied on said cross member. During continued extension of mechanism 8, the arms are pivoted relative to each other to the position according to FIG. 4. The forward wedge portion 12 of element 11 is maintained pivoted upwardly and in contact with roller 24 by the torque exerted on the element due to the location of hinge 22 below the contact area between dog 18 and cross member 28.

Modifications of the device are of course possible within the scope of the invention.

We claim:

1. A device for raising and lowering objects, such as bed frames and work tables, comprising:

a stand;

a first arm pivotable around a pivot axis carried by the stand and being adapted to support the object in question, an extensible power mechanism fixed to said stand;

an element pivotally connected to the power mechanism by a hinge and being displaceable generally perpendicularly to the pivot axis of the first arm by extension of said power mechanism and having an end introducable between a portion of the first arm and a section of the stand located below said end of said element so as to move said arm and said stand away from each other by wedging contact therewith upon extension of said power mechanism, and thereby pivoting the first arm upwardly from the stand;

a second arm hingedly connected to the first arm and having an end portion facing away from said first arm for cooperation with a guide arranged in the stand, said guide extending perpendicularly to the pivot axis of the first arm, said second arm being displaceable and pivotable relative to said guide;

and a dog integrally connected to the element and, starting from a maximally downwardly pivoted position of the first arm, engaging the end portion of the second arm after an initial displacement of the element and after associated initial upward pivoting of the first arm, said hinge between the element and the power mechanism being disposed below the end portion of the second arm such that the dog pivots about said end portion of said second arm to move the end of said element upwardly upon continued extension of the mechanism so as to further pivot said first arm upwardly after termination of said wedging contact.

2. A device according to claim 1, said portion of the first arm being formed by a roller arranged about a pin shaft forming the hinge between the arms, characterized in that the section of the stand is formed by a second roller.

3. A device according to claim 1, characterized in that the end of the element has its outer extremety retained between said portion of the first arm and said section of the stand when said arm is maximally pivoted downwardly towards the stand and the element is maximally retracted.

4. A device according to claim 1, said element having a generally horizontal extent in its maximally retracted position and the end of the element having an upper upwardly sloping wedge surface, characterized in that the end of the element in the retracted position of the element has a downwardly sloping second wedge surface for cooperation with said section of the stand.

* * * * *